US006347751B1

(12) United States Patent
Kuo

(10) Patent No.: US 6,347,751 B1
(45) Date of Patent: Feb. 19, 2002

(54) SWIVEL LAWN SPRINKLER

(75) Inventor: Mu Shui Kuo, Taipei (TW)

(73) Assignee: Sanmaonet Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/822,243

(22) Filed: Apr. 2, 2001

(51) Int. Cl.[7] ..... B05B 3/06

(52) U.S. Cl. ..... 239/251; 239/17; 239/211; 239/225.1; 239/261; 239/263; 239/264; 239/273; 239/280; 239/289; 40/419; D23/215; D23/222

(58) Field of Search ..... 239/16, 17, 211, 239/225.1, 236, 242, 248, 251, 253, 255, 261, 263, 264, 273, 279, 280, 289; 446/267, 275; 40/412, 417, 419; D23/215, 222; D21/606

(56) References Cited

U.S. PATENT DOCUMENTS

RE6,560 E * 7/1875 Brusie
1,790,732 A * 3/1931 Tichava
3,744,721 A * 7/1973 Baumstark, Jr.
6,250,565 B1 * 6/2001 Ogie et al. ..... 239/211

* cited by examiner

*Primary Examiner*—Robin O. Evans
(74) *Attorney, Agent, or Firm*—Rosenberg, Klein & Lee

(57) ABSTRACT

A swivel lawn sprinkler includes a mounting rack for mounting, a water tube vertically connected to the mounting rack by a hose connector and adapted to receive water from a water source through the hose connector, a pipe connector fastened to the top end of the water tube, the pipe connector having a collar of oval profile disposed around the periphery thereof, and a swivel sprinkler head coupled to the pipe connector and forced to rotate on the pipe connector upon passing of water from the water tube, the swivel sprinkler head having a figured frame, and two wings coupled to figured frame and forced by the periphery of the collar of oval profile to move up and down upon rotary motion of the swivel sprinkler head on the pipe connector.

1 Claim, 4 Drawing Sheets

SWIVEL LAWN SPRINKLER

BACKGROUND OF THE INVENTION

The present invention relates to lawn sprinklers and, more particularly, to a swivel lawn sprinkler, which oscillates two wings when the figured swivel sprinkler head thereof is rotating during sprinkling.

In parks, gardens, square plazas, or the like, lawn sprinklers may be provided to sprinkle water on flowers, lawns, trees, and etc. Regular lawn sprinklers are commonly comprised of a fixed spray tube having a plurality of jet nozzles for output of water. These conventional lawn sprinklers do not attract people's attention when sprinkling water on plants because they are immovable.

SUMMARY OF THE INVENTION

It is one object of the present invention to provide a lawn sprinkler, which has a figured swivel sprinkler head that attracts people's attention when sprinkling water on the lawn. It is another object of the present invention to provide a lawn sprinkler, which is forced to rotate the sprinkler head thereof when sprinkling water on the lawns. It is still another object of the present invention to provide a swivel lawn sprinkler, which moves two wings up and down upon rotary motion of the sprinkler head thereof during sprinkling.

DETAILED DESCRIPTION OF THE PREFERRED EMBODIMENT

Figure 1:
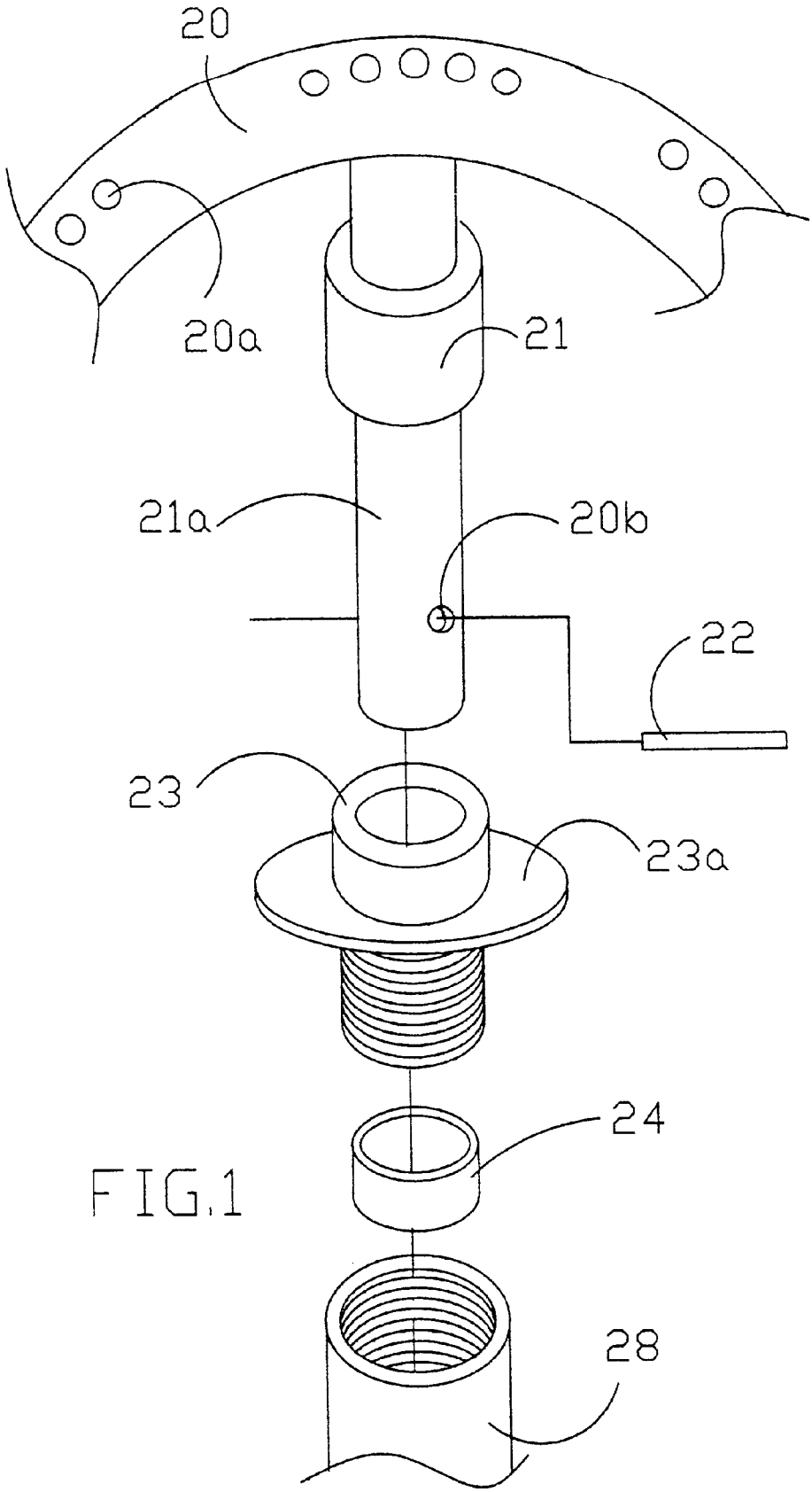
FIG. 1 is an exploded view of a part of the swivel lawn sprinkler according to the present invention.

Referring to FIGS. from 1 through 3, a swivel lawn sprinkler in accordance with the present invention is generally comprised of a swivel sprinkler head 200, a pipe connector 23, a water tube 28, a hose connector 29, and a mounting rack 30. The sprinkler head 200 comprises a figured frame 25, two axles 26*a*horizontally provided in the figured frame 25 at two sides, a spry tube 20 fixedly fastened to the figured frame 25 and disposed above the axles 26*a*, the spray tube 20 having a plurality of jet nozzles 20*a*, two L-shaped oscillating plates 26 respectively coupled to and adapted to turn about the axles 26*a*, two wings 27 respectively fastened to the L-shaped plates 26 at a top side, and a connecting tube 21 downwardly extended from the spray tube 20 and adapted to guide water into the spray tube 20. The connecting tube 21 has a transverse pinhole 20*b* extended through the lower section 21*a* thereof. The pipe connector 23 is sleeved onto the lower section 21*a* of the connecting tube 21, having a collar of oval profile 23*a* disposed around the periphery on the middle. After insertion of the lower section 21*a* of the connecting tube 21 through the pipe connector 23, a locating ring 24 is sleeved onto the lower section 21*a* of the connecting tube 21 and stopped against the bottom edge of the pipe connector 23, and then a locating pin 22 is fastened to the pin hole 20*b* of the connecting tube 21 to secure the locating ring 24 and the pipe connector 23 to the connecting tube 21, and then the threaded bottom end of the pipe connector 23 is threaded into the inner threads in the top end of the water tube 28 to secure the connecting tube 21 and the spray tube 20 to the water tube 28. The hose connector 29 is a three-way pipe fitting, having a first end connected to the bottom end of the water tube 28, a second end connected to the mounting rack 30 and sealed, and a third end connected to the water source by a hose (not shown).

Figure 2:
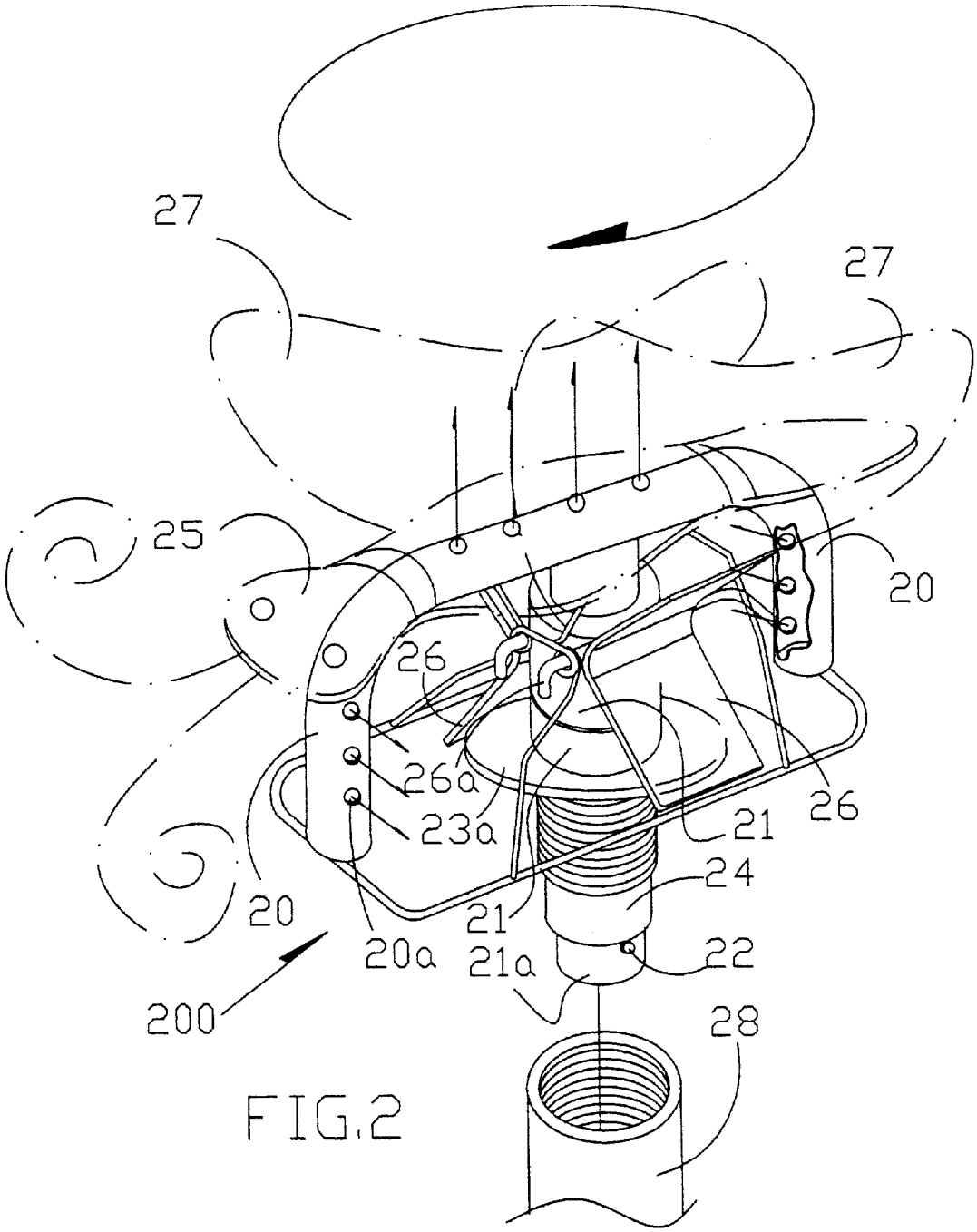
FIG. 2 is a perspective view of the swivel lawn sprinkler according to the present invention.
Figure 2A:
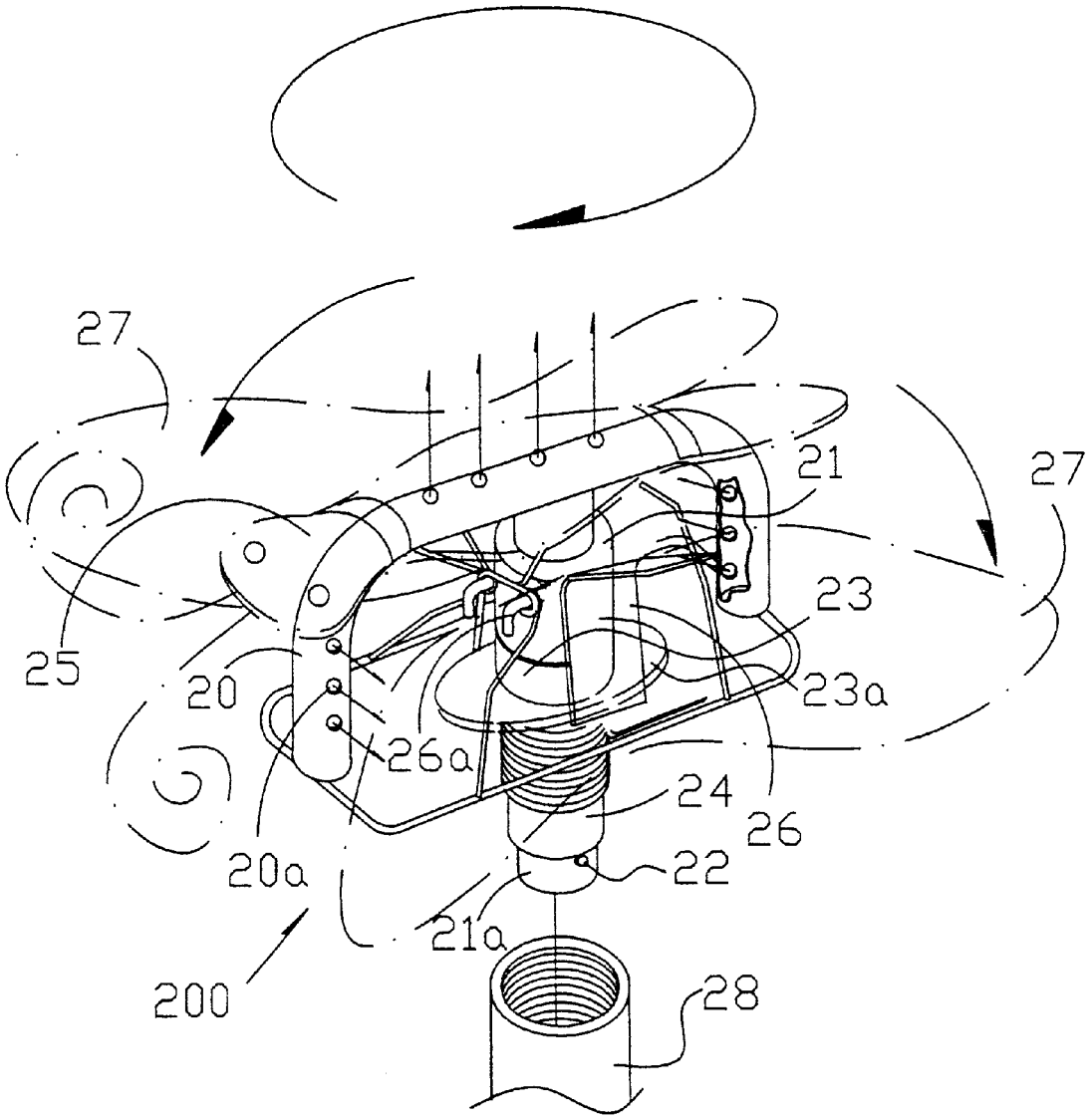
FIG. 2A illustrates the action of the swivel lawn sprinkler according to the present invention.
Figure 3:
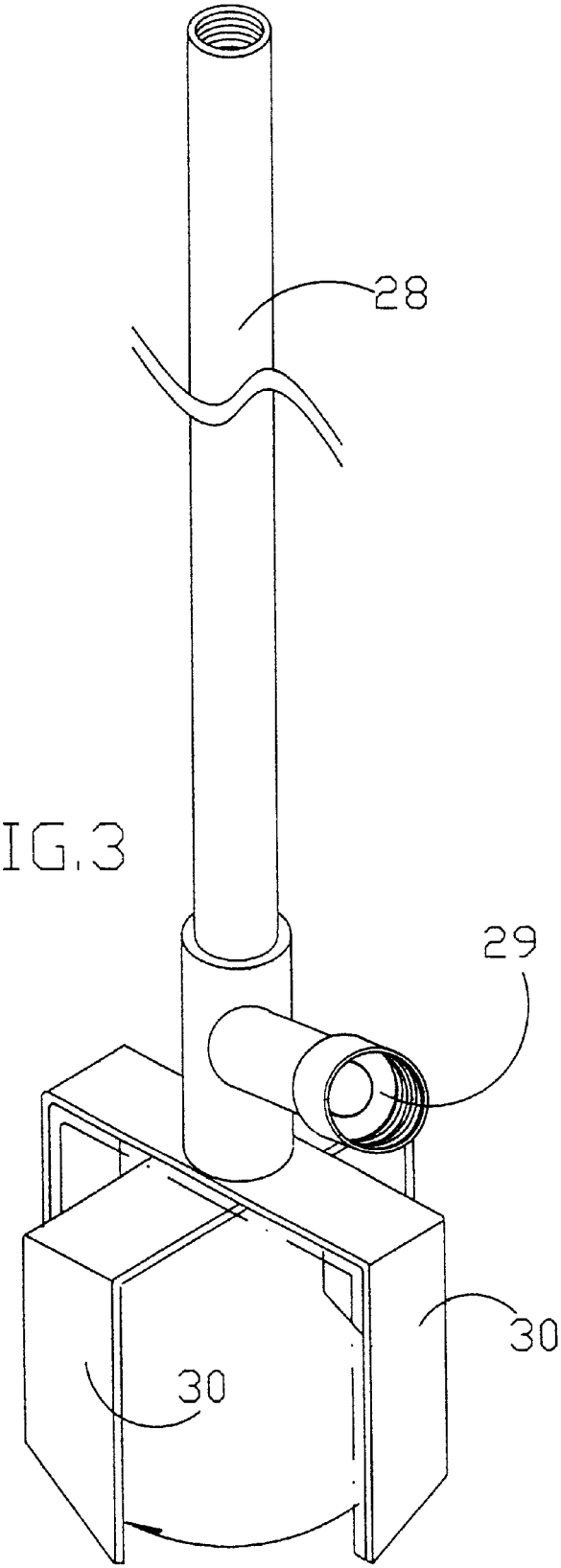
FIG. 3 illustrates the hose connector connected between the rack and the water tube according to the present invention.

Referring to FIG. 2A, when water is guided from the water source to the swivel sprinkler head 200, it is forced out of the jet nozzles 20*a* to sprinkled on flowers, lawns, and etc. At the same time, the pressure of water passing through the spray tube 20 forces the swivel sprinkler head 200 to rotate on the pipe connector 23 at the water tube 28. When rotating the swivel sprinkler head 200 on the pipe connector 23, the L-shaped oscillating plates 26 are moved up and down along the periphery of the collar of oval profile 23*a* of the pipe connector 23, and therefore the wings 27 are moved up and down with the L-shaped oscillating plates 26, simulating the flying action of a flying insect.

A prototype of swivel lawn sprinkler has been constructed with the features of the annexed drawings. The swivel lawn sprinkler functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A swivel lawn sprinkler comprising:

a mounting rack for mounting;

a water tube, said water tube having a bottom end and a top end;

a hose connector connected between said mounting rack and the bottom end of said water tube to support said water tube on said mounting rack and adapted to receive water from a water source through a hose;

a pipe connector fastened to the top end of said water tube, said pipe connector comprising a collar of oval profile disposed around the periphery thereof; and a swivel sprinkler head coupled to said pipe connector and forced to rotate on said pipe connector upon passing of water from said water tube, said swivel sprinkler head comprising a figured frame, two axles horizontally provided in said figured frame at two sides, a spray tube fixedly fastened to said figured frame and disposed above said axles, said spray tube having a plurality of jet nozzles, two L-shaped oscillating plates respectively coupled to and adapted to turn about said axles and disposed in contact with the periphery of said collar of oval profile, two wings respectively fastened to said L-shaped plates at a top side, and a connecting tube downwardly extended from said spray tube inserted into said pipe connector for enabling said swivel sprinkler head to be rotated on said pipe connector upon passing of water from said water tube to said spray tube.

* * * * *